United States Patent [19]

Yamaguchi et al.

[11] Patent Number: 4,771,032

[45] Date of Patent: Sep. 13, 1988

[54] HEAT-SENSITIVE RECORDING MATERIAL AND RECORDING METHOD THEREFOR

[75] Inventors: Jun Yamaguchi; Toshiharu Tanaka; Toshimasa Usami, all of Shizuoka; Sadao Ishige, Kanagawa, all of Japan

[73] Assignee: Fuji Photo Film Co., Ltd., Kanagawa, Japan

[21] Appl. No.: 760,781

[22] Filed: Jul. 31, 1985

[30] Foreign Application Priority Data

Jul. 31, 1984 [JP] Japan ..... 59-162361
Jul. 31, 1984 [JP] Japan ..... 59-162362

[51] Int. Cl.[4] ..... B41M 5/18

[52] U.S. Cl. ..... 503/201; 427/150; 427/151; 427/256; 430/138; 430/142; 430/151; 503/204; 503/215; 503/217

[58] Field of Search ..... 346/200, 201, 204, 209, 346/216–218, 225, 215; 427/150–152, 256; 430/138, 151, 176, 177, 142, 156, 172, 173; 503/200, 201, 204, 209, 215, 217

[56] References Cited

U.S. PATENT DOCUMENTS 3,069,268 12/1962 Herrick ..... 430/156
3,202,510 8/1965 Hollmann ..... 430/138
3,484,241 12/1969 Evleth et al. ..... 430/156
4,529,681 7/1985 Usami et al. ..... 430/138

FOREIGN PATENT DOCUMENTS 0138979 8/1982 Japan ..... 346/217
0212095 12/1982 Japan ..... 346/217
0008690 1/1983 Japan ..... 346/217
0036485 3/1983 Japan ..... 346/217
0055288 4/1983 Japan ..... 346/217
0081195 5/1983 Japan ..... 346/217

OTHER PUBLICATIONS

Schreiber et al., "Multicolor Diazo Imaging Elements", Research Disclosure, Mar. 1975.

*Primary Examiner*—Bruce H. Hess
*Attorney, Agent, or Firm*—Sughrue, Mion, Zinn, Macpeak & Seas

[57] ABSTRACT

A heat-sensitive recording material and a recording method are disclosed, wherein the heat-sensitive recording material comprises a support having formed thereon plural heat-coloring elements each comprising a diazo compound and a coupling component capable of causing heat-coloring, the heat-coloring elements coloring in two or more different hues, and the coloring property in each heat-coloring element being capable of being stopped by the action of different radiations, and the recording method comprises first heat-coloring a heat-coloring element of the heat-sensitive recording material, stopping the heat-coloring property of the uncolored portions of the first heat-coloring element by radiation, and then heat-coloring another heat-coloring element; wherein the recording method comprises applying two or more heat-coloring procedures and one or more irradiations of radiation to form recorded images composed of two or more colors on the same sheet.

11 Claims, No Drawings

HEAT-SENSITIVE RECORDING MATERIAL AND RECORDING METHOD THEREFOR

FIELD OF THE INVENTION

This invention relates to heat-sensitive recording material and, more particularly, to heat-sensitive recording materials coloring (i.e., forming colors) in multicolors and also to a recording method using the heat-sensitive recording material.

More specifically, the invention relates to a heat-sensitive recording material capable of obtaining a print image of a different color hue by selectively photodecomposing at least one coloring component in a specific unit coloring group between a heat print and another heat print.

BACKGROUND OF THE INVENTION

With the rapid development of the information industry, the desire for easily obtaining a hard color copy from the data terminal of an information processing device such as a computer, facsimile, etc., has increased. For meeting this desire, ink jet systems and heat-sensitive transfer systems have been investigated. However, ink jet systems have drawbacks in that since the system is performed by jetting an ink containing a coloring material through fine nozzles, the nozzles are liable to be clogged by the coloring material, etc., to reduce the reliability of recording. Also, heat-sensitive transfer systems involve imagelike heating and melting an ink on an ink sheet to transfer the ink onto a paper sheet, and hence for obtaining a color image of, for example, four colors, it is required to use four ink sheets, which is uneconomical. Also, in the case of the ink jet system, the user must always take care so that the ink does not become deficient, and in the case of the heat-sensitive transfer system, the user must always care so that the ink sheets do not become deficient. In other words, both systems compel the user to undertake a troublesome control of materials.

On the other hand, as a system which does not require such a troublesome control of materials and shows a high reliability of recording, a heat-sensitive coloring system is known and this system has recently been rapidly employed in the fields of black-and-white facsimile and for printers. In this system, a recording material composed of a support having thereon a layer having coloring mechanism and since the system is simple and convenient, the development of a multicolor heat-sensitive coloring system has been desired.

However, for realizing multicolor recording in the heat-sensitive coloring system, it is necessary to apply coloring mechanisms corresponding to the number of coloring colors on the same support together with function of controlling each coloring mechanism. Various efforts have hitherto been made, but the coloring control has so far been insufficient. Such efforts are described further below.

As recording materials for multicolor recording system, there are, for example, a recording material containing in the same heat-sensitive coloring layer a mixture of two kinds of coloring components coloring in different color hues at different coloring temperatures as described in Japanese Patent Publication No. 69/74 and a recording material composed of a support having formed thereon, in succession, a high temperature heat-sensitive coloring layer containing a coloring component coloring at a high temperature and a low temperature heat-sensitive coloring layer containing a coloring component coloring at a low temperature, as described in Japanese Patent Publication No. 19989/76, Japanese Patent Application (OPI) Nos. 88135/79, 133991/80, 133992/80 and 15540/73 (the term "OPI" as used herein refers to a "published unexamined Japanese patent application"). Furthermore, there is also a recording material having the above described high temperature coloring layer and low temperature coloring layer, further containing, associated with the low temperature coloring layer, an achromatizing agent, and showing an achromatizing effect with respect to the coloring component in the low temperature coloring layer at the portions corresponding to the colored portions of the high temperature coloring layer in the case of forming the images of the high temperature coloring layer as described in Japanese Patent Publication Nos. 17866/75, 5791/76, Japanese Patent Application (OPI) No. 161688/80.

However, these conventional multicolor heat-sensitive recording materials have various difficulties and are not satisfactory. For example, when low temperature and high temperature colored images having different color hues are formed by low temperature and high temperature printings using the recording material having on a support one or two heat-sensitive coloring layers, the color hue of the high temperature colored image causes color mixing with the hue of the low temperature colored image and the extent of color mixing changes when the printing conditions (the temperature, humidity and the kind of the printing machine) are changed, whereby images of a constant and stable color hue are not obtainable. Also, since at high temperature printing, regions having the same temperature as that of a low temperature printing are formed at the peripheral portions of the high temperature printing regions, a low temperature coloring occurs at the periphery of the high temperature printed image. This phenomenon is generally referred to as shading or bleeding (or ooze), which reduces the clearness of the images formed.

Moreover, in the recording material having an achromatizing mechanism, the occurrence of color mixing can be prevented, but the problem of causing color bleeding has not yet been solved.

SUMMARY OF THE INVENTION

An object of this invention is to provide a coloring type multicolor heat-sensitive recording material having a coloring mechanism for coloring in desired hue, and causing no or less color mixing, and also to provide a recording method therefor.

Other object of this invention is to provide a coloring type multicolor heat-sensitive recording material capable of forming clear images without causing color ooze or color bleeding and moreover to provide a recording method therefor.

That is, it has now been discovered that the above objects of this invention are attained by the present invention as set forth below in detail.

This invention relates to (1) a heat-sensitive recording material comprising a support having formed thereon plural heat-coloring elements each comprising a diazo compound and a coupling component capable of causing heat-coloring, said heat-coloring elements coloring in two or more different hues, and the coloring property in each heat-coloring element being capable of being stopped by the action of different radiations, and (2) a recording method comprising first heat-coloring a heat-coloring element of the heat-sensitive recording material, stopping the heat-coloring property of the uncolored portions of the first heat-coloring element by radiation, and then heat-coloring another heat-coloring element; wherein the recording method comprises applying two or more heat-coloring procedures and one or more irradiations of radiation to form recorded images composed of two or more colors on the same sheet.

DETAILED DESCRIPTION OF THE INVENTION

Then, the invention is explained in detail.

The method of this invention can be classified into the following two methods (A) and (B).

Method (A):

A recording method by first heat-coloring a heat-coloring element, which is colored at the lowest temperature, of a heat-sensitive recording material comprising a support having formed thereon plural heat-coloring elements each heat-coloring at different coloring temperatures, and being able to stop the coloring property thereof by the action of radiation, and after stopping the coloring property of the uncolored portions of the heat-coloring element by radiation, heat-coloring another heat-coloring element, which is colored at a high temperature; wherein the recording method comprises performing two or more heat-coloring procedures and one or more irradiations of radiation.

The method (A) of this invention is explained below in further detail.

The heat-sensitive recording material of this invention has on a support plural unit coloring groups (heat-coloring elements) $G_1, G_2, \ldots G_n$ (n is an integer of at least 2).

A heat-sensitive recording material having the following features (a) to (d), (a) said recording material being composed of at least two unit coloring groups $G_i$ (i is an integer) each having a function of coloring when heated to a specific temperature $T_i$°C. above normal (room) temperature (about 25° C.), (b) each coloring temperature $T_i$ in (a) being different from each other and $T_1<T_2<T_3 \ldots <T_l$ $(2 \leqq l \leqq n)$, (c) at least one of said two or more unit coloring groups in (a) being selectively photodecomposed, in substantial meaning, by light containing a component of wavelength $\lambda_i$ (nm) (200 nm$<\lambda_i<$700 nm) applied from outside the recording material, and (d) compounds other than the photodecomposable compound(s) may be common, if desired, to the compound(s) belonging to other unit coloring group(s), is first heated to a temperature higher than $T_1$ and lower than $T_2$ to color the unit coloring group $G_1$ only.

Then, the recording material is irradiated by light containing a component of wavelength $\lambda_1$ to photodecompose the photodecomposable compound in unit coloring group $G_1$, whereby coloring of group $G_1$ is stopped. Then, the recording material is heated to a temperature higher than $T_2$ and lower than $T_3$ to color unit coloring group $G_2$ only and thereafter the photodecomposition and temperature controlled printout are repeated to successively printout color each unit coloring group separately, whereby multicolor images having a desired hue can be obtained.

According to this method (A) of this invention, each unit coloring group can be desirably and successively colored separately and by utilizing the characteristics described above, multicolor images having no color mixing and color ooze can be obtained. In addition, when the photodecomposable compound in unit coloring group $G_i$ is selectively photodecomposed, it is not always necessary to use a monochromatic light of wavelength $\lambda_i$ but a compound light comprising a light of wavelength $\lambda_i$ and light of other wavelengths may be employed when other photodecomposable compound(s) are not photodecomposed by the compound light at the same time.

If desired, however, other photodecomposable compound(s) may be photodecomposed at the same time.

Also, the unit coloring group which is finally heat-colored may not be subjected to photodecomposition.

Method (B):

A recording method by first heat-coloring a heat-coloring element of a heat-sensitive recording material comprising a support having formed thereon plural heat-coloring elements each having substantially the same coloring temperature but coloring in a different hue, and said plural heat-coloring element each being able to stop the heat-coloring property by the action of radiation having different wavelength, and after stopping the heat-coloring property of the uncolored portions of the heat-coloring element, heat-coloring other heat-coloring element at substantially the same temperature as the first coloring temperature; wherein the recording method comprises performing two or more heat-coloring procedures and one or more irradiations of radiation to form recorded images composed of two or more colors.

The method (B) of this invention is then explained below in detail.

The heat-sensitive recording material of this invention has on a support plural unit coloring groups (heat-coloring elements) $G_1, G_2 \ldots G_n$ (n is an integer of at least 2) each coloring in different hue.

The heat-sensitive recording material having the following features (a) to (c), (a) the recording material having two or more unit coloring groups $G_i$ (i is an integer) having a function of coloring when heated at a temperature higher than normal (room) temperature (e.g., about 25° C.), (b) at least one of said two or more unit coloring groups being selectively photodecomposed by light containing a component of wavelength $\lambda_i$ (nm) (200 nm$<\lambda_i<$700 nm), and (c) compounds other than the photodecomposable compound may be common, if desired, to the compounds belonging to other unit coloring group(s), is printed, and the photodecomposable compound in unit coloring group $G_i$ is, in substantial meaning, photodecomposed by light containing wavelength $\lambda_i$, whereby the unit coloring group $G_i$ is brought into a state of being not colored at printing. Thereafter, by performing subsequent printing out, images containing no hue of $G_i$ can be surely obtained. Thereafter, by successively repeating the photodecomposition and printing out, images of hues in which each has a colored hue free from the hue(s) of the previously photodecomposed unit coloring group(s) are obtained. That is, by the method of this invention, multicolor printout images having controlled hue can be obtained. Also, according to the method of this invention, it is unnecessary to change the printing temperature for changing the hue of images and fundamentally the coloring initiating temperature of each unit coloring group can be set at almost the same temperature. Therefore, clear images having no color ooze, which is one of the objects of this invention, can be obtained.

However, in the case of selectively photodecomposing the photodecomposable compound in unit coloring group $G_i$, it is not always necessary to use a monochromatic light of wavelength $\lambda_i$ but in the meaning of selectively photodecomposing, it is necessary to define the spectral wavelength region of light of wavelength $\lambda_i$ so that the photodecomposable compound(s) in other unit coloring group(s) are not decomposed. However, as the case may be, the compound(s) in other unit coloring group(s) may be photodecomposed at the same time. Also, the unit coloring group finally heat-colored is not subject to photodecomposition.

In the above described recording methods (A) and (B), the following heat-sensitive recording materials can be used, respectively.

That is, for recording method (A), the following heat-sensitive recording materials (A)-(1) and (A)-(2) are used.

(A)-(1): A heat-sensitive recording material comprising a support having formed thereon plural heat-coloring elements (unit coloring groups) each composed of a diazo compound and a coupling component and causing heat-coloring, said heat-coloring elements each coloring at a different temperature, and said diazo compounds in the plural heat-coloring elements being decomposed by radiation having different wavelengths.

(A)-(2): A heat-sensitive recording material comprising a support having formed thereon plural heat-coloring elements each composed of a diazo compound and a coupling component and causing heat-coloring, said heat-coloring elements each coloring at a different temperature and said diazo compounds in the plural heat-coloring elements each existing in microcapsules and being decomposed by radiation having different wavelengths.

For recording method (B), the following heat-sensitive recording materials (B)-(1) and (B)-(2) are used.

(B)-(1): A heat-sensitive recording material comprising a support having formed thereon plural heat-coloring elements each composed of a diazo compound and a coupling component and causing heat-coloring, said heat-coloring elements each having substantially the same coloring temperature but coloring in a different hue and the diazo compounds forming the plural heat-coloring elements each being decomposed by radiation having different wavelengths.

(B)-(2): A heat-sensitive recording material comprising a support having fromed thereon plural heat-coloring elements each composed of a diazo compound and a coupling component and causing heat-coloring, said diazo compounds in the plural heat-coloring elements each existing in microcapsules, said plural heat-coloring elements each having substantially the same coloring temperature but coloring in a different hue, and the diazo compounds forming the plural heat-coloring elements each being decomposed by radiation having different wavelengths.

Then, the multicolor heat-sensitive recording material of this invention is explained in more detail.

Each unit coloring group for the recording material of this invention is fundamentally composed of a diazo compound, a coupler, and, if desired, a basic material or acidic material. Also, the hue in coloring each unit coloring group is mainly determined by the diazo dye formed by the reaction of the diazo compound and the coupler. Accordingly, by changing the chemical structure of the diazo compound or the chemical structure of the coupler, the coloring hue can be easily changed, as is well known, and virtually any coloring hues desired can be easily obtained by changing the combination of the diazo compound and the coupler.

As one embodiment of the recording material, various diazo compounds (plural kinds of diazo compounds) are dispersed in one layer and one kind of coupler and other additives, if any, may be incorporated in the same layer. In this case, each unit coloring group is composed of each different diazo compound and a one kind coupler being common to other unit coloring groups and other additives.

As another embodiment of the recording material, different couplers are each dispersed in each different layer and the same kind of a diazo compound and the same kind(s) of additive(s) may be incorporated in each layer. In this case, each unit coloring group is composed of each different coupler and the common diazo compound and additives to other unit coloring group. In any case, each unit coloring group is composed of at least one diazo compound and at least one coupler so associated as to show different color hue, and other additive(s).

The selective photodecomposition in this invention is explained in more detail below. The photodecomposable compound for use in this invention mainly means an aromatic diazo compound and more specifically means an aromatic diazonium salt, an aromatic diazosulfonate compound, an aromatic diazoamino compound, etc. Hereinafter, the selective photodecomposition is explained mainly with respect to the case of using the diazonium salt. That is, for performing the selective photodecomposition in this invention, the following two kinds of methods can be employed: (1) a method of changing the photodecomposing wavelength by changing the chemical structure of the diazonium salt for use; and (2) a method of fractionalizing light reaching the photodecomposable compound in a unit coloring group $G_i$ using a filter layer, etc.

Method (1) described above is generally well known. Usually, it is said that the photodecomposing wavelength of a diazonium salt is the absorption maximum wavelength thereof. Also, it is known that the absorption maximum wavelength of a diazonium salt changes from about 200 nm to about 700 nm according to the chemical structure thereof as described, for example, in the report by Takahiro Tsunoda and Shigeo Yamaoka entitled "Photodecomposition and Chemical Structure of Photosensitive Diazonium Salts", *Journal of the Society of Photographic Science and Technology of Japan,* Vol. 29 (4), pages 197–205 (1965). That is, when a diazonium salt is used as a photodecomposable compound, the diazonium compound is decomposed by light of a specific wavelength according to the chemical structure thereof and also by changing the chemical structure of a diazonium salt, the hue of dye formed in the coupling reaction with a coupler can be changed. Thus, this method can be preferably used in this invention.

Then, selective photodecomposition method (2) described above is explained. For example, a dispersion of a diazonium salt capable of causing photodecomposition by light of 400 to 430 nm, a dispersion of a coupler, and a dispersion of an alkali are incorporated in the upper layer of the recording material; a filter layer having dispersed therein a light absorptive compound capable of shielding light having wavelengths of less than 415 nm is formed under the above described upper layer; and further a layer containing the same components as those of the upper layer except a coupler only, i.e., containing a different coupler than that of the upper layer and showing a different coloring hue than the upper layer is formed under the filter layer. This recording material is first subjected to heat printing to color the upper layer and the lower layer. Then, the recording material is irradiated by light having a light component of wavelengths longer than 415 nm to photodecompose the diazonium salt in the upper layer. Then, the recording material is subjected to heat printing again to color the lower layer only, and thereafter, the recording material is irradiated by light having a light component of wavelengths shorter than 415 nm.

Thus, by providing a light filter layer in the recording material as described above or covering the diazonium particles in the lower layer of the recording material with a material having a light filtering property, the photodecomposition of the diazonium salts can be selectively performed. Thus, the aforesaid method can also be advantageously employed in this invention.

The methods of controlling coloring temperature in this invention are generally classified into the following two methods.

One of them is a method which can be advantageously used in the case of using capsule walls, wherein by changing the kind of the materials of the capsule walls, the permeability of the capsule walls can be changed to remarkably change the coloring temperature. As examples of this method, there are methods of forming the capsule walls by polyurethane, by polyurea, by a mixture of polyurethane and polyurea, etc., and a method of changing the chemical structure between ureas or urethanes.

The other method is a method of using a multilayer structure. The coloring aid for use in this invention is used for decreasing the coloring temperature and by changing the addition amount of the coloring aid for each layer, the coloring temperature can be easily controlled.

Also, if desired, these methods can be combined. Furthermore, the invention is not limited to the aforesaid methods.

In this invention, some components for constituting the unit coloring group may be coated as the form of a dispersion, certain components thereof may be coated as a solution, or all the components may be coated as the form of dispersion thereof as described in the report by Hiroji Sato et al. entitled "Investigation on Diazo Coloring Light-Fixing Type Heat-Sensitive Recording Papers", *Gazo Denshi Gakkai Shi,* Vol. 11 (4), pages 290–296 (1982), etc.

In the case of coating the component(s) as a dispersion thereof, each component or components may be used as so-called "solid dispersion" using a sand mill, a ball mill, horizontal sand mill (Dyno Mill), etc., or may be microencapsulated together with a water-insoluble organic solvent. Or some component(s) may be used as a solid dispersion and other component(s) may be microencapsulated. In the case of using the microcapsules, reactive components existing inside and outside the microcapsules in the layer of the recording material cause a reaction through the walls of the microcapsules at heating. In this case, if an organic solvent exists in the microcapsules, the formation of coloring fog at the storage of the recording material is greatly reduced and, on the other hand, coloring speed and coloring density at heating are greatly increased and, thus, the system of such microcapsules can be preferably used in this invention.

It is considered that the existence of the organic solvent increases the coloring speed and coloring density because the wall of the microcapsule is swelled by the organic solvent at heating to accelerate the permeation of the reactive component. Also, it is considered that the rate determining step of the coloring reaction is the dissolution of the reactants or reactive components in each other and if an organic solvent exists in this case, the dissolving speed of the reactants in each other is increased at heating, which results in increasing the coloring speed and coloring density.

Decreases in the formation of coloring fog during the storage of the recording material are against the general tendency in this field of art, and hence the above described effect in this invention is quite surprising.

In particular, when a diazo compound in the components for each unit coloring group is incorporated in the microcapsules, the reduction effect for the formation of coloring fog during the storage of the recording material is large, and hence this embodiment is preferable in this invention.

It is preferred that at least one of the reactive materials such as a diazo compound, a coupling component, a coupling aid, etc., which becomes a part of the core materials of the microcapsules is dissolved or dispersed in an organic solvent and the core material containing the reactive material and the organic solvent is microencapsulated by a wall material formed by a polymerization method such as an interfacial polymerization, an external polymerization, and an internal polymerization. As the wall material, polyurethane, polyurea, polyamide, or polyester is preferably used.

The organic solvent which is used for the core material is a water-insoluble high boiling organic solvent. It is preferred that the organic solvent has a boiling point of 180° C. or higher than 180° C. and specific examples of such solvent includes phosphoric acid esters, phthalic acid esters, carboxylic acid esters, fatty acid amides, alkylated biphenyls, alkylated terphenyls, chlorinated paraffin, alkylated naphthalenes, diarylethane, etc.

Practical examples of the organic solvent are tricresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, acetyltriethyl citrate, octyl maleate, dibutyl maleate, isopropylbiphenyl, isoamylbiphenyl, chlorinated paraffin, diisopropylnaphthalene, 1,1'-ditolylethane, 2,4-di-tertiary-aminophenol, N,N-dibutyl-2-butoxy-5-tertiary octylaniline, etc. Among these solvents, the ester series solvents such as dibutyl phthalate, diethyl phthalate, dibutyl maleate, etc., are particularly preferred.

Also, at the case of performing the microencapsulation, halogenated alkyl compounds such as methylene chloride, dichloroethane, trichloroethane, etc., or various ester compounds such as ethyl acetate, propyl acetate, methyl propionate, etc., may be used together with the above described high boiling organic solvent as an auxiliary solvent.

The diazo compound which can be used in this invention is a compound capable of causing a coupling reaction with a coupling component and capable of being photodecomposed, such as diazonium salts shown by formula $ArN_2^{\oplus}X^{\ominus}$, wherein Ar represents a substituted or unsubstituted aromatic moiety, $N_2^{\oplus}$ represents a diazonium group, and $X^{\ominus}$ represents an acid anion, diazo sulfonates, and diazoamino compounds.

In this invention, a preferred embodiment thereof is to use diazonium salts which are each photodecomposed by light of a different wavelength. As diazonium compounds having the photodecomposable wavelength at about 400 nm, there are, for example, 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, 4-diazo-1,4-methoxybenzoylamino-2,5-diethoxybenzene, etc. Also, as diazonium compounds having a photodecomposable wavelength at about 300 to 370 nm, there are, for example, 1-diazo-4-(N,N-dioctylcarbamoyl)benzene, 1-diazo-2-octadecyloxybenzene, 1-diazo-4-(4-tertiary-octylphenoxy)benzene, 1-diazo-4-(2,4-ditertiary-amylphenoxy)benzene, 1-diazo-2-(4-tertiary-octylphenoxy)benzene, 1-diazo-5-chloro-2-(4-tertiary-octylphenoxy)benzene, 1-diazo-2,5-bisoctadecyloxybenzene, 1-diazo-2,4-bis-octadecyloxybenzene, 1-diazo-4-(N-octyllauroylamino)benzene, etc.

The above illustrated aromatic diazonium compounds can optionally change the photodecomposable wavelength over a wide range by changing the kind(s) of substituent(s).

Specific acid anions for use in this invention are $C_nF_{2n+1}COO^{\ominus}$ (wherein n represents 3 to 9), $C_mF_{2m+1}SO_3^{\ominus}$ (wherein m represents 2 to 8), $(ClF_{2+1}SO_2)_2CH^{\ominus}$ (wherein l represents 1 to 18),

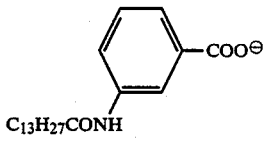

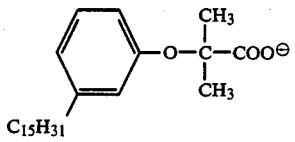

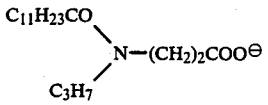

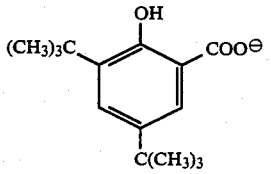

-continued

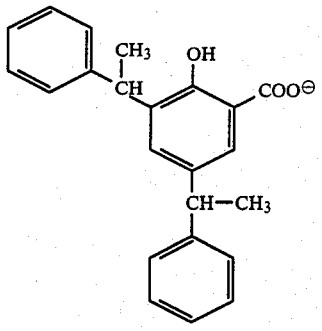

$BF_4$, $PF_6$, etc.

Specific examples of diazo compounds (diazonium salt) are as follows:

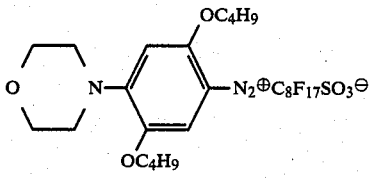

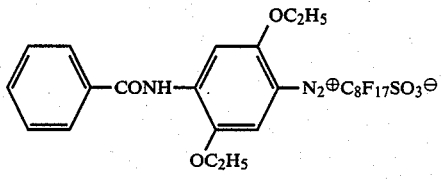

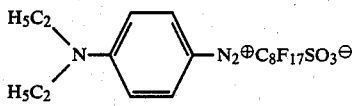

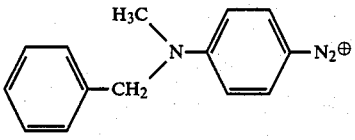

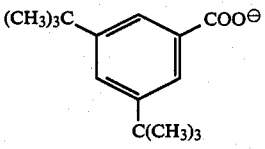

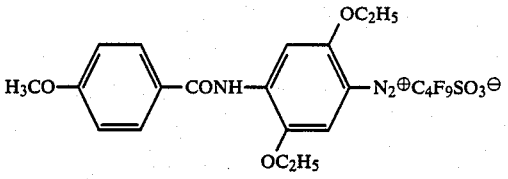

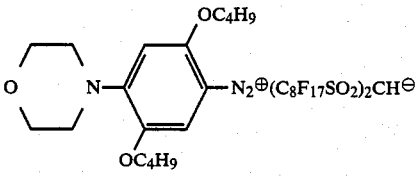

-continued

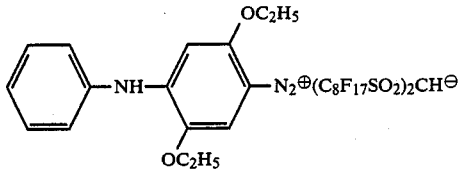

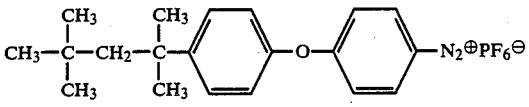

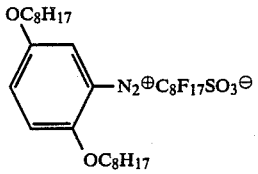

The diazo sulfonate compounds which can be used in this invention are preferably compounds shown by the formula:

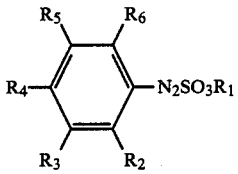

wherein $R_1$ represents an alkali metal or an ammonium compound; $R_2$, $R_3$, $R_5$ and $R_6$ each represents a hydrogen atom, a halogen atom, an alkyl group or an alkoxy group; and $R_4$ represents a hydrogen atom, a halogen atom, an alkyl group, an amino group, a benzoylamino group, a morpholino group, a trimercapto group, or a pyrrolidino group.

Various kinds of such diazo sulfonates are known and they can be obtained by treating corresponding diazonium salts with a sulfite.

Examples of the preferred diazo sulfonates are benzenediazo sulfonates having a substituent such as a 2-methoxy group, a 2-phenoxy group, a 2-methoxy-4-phenoxy group, a 2,4-dimethoxy group, a 2-methyl-4-methoxy group, a 2,4-dimethyl group, a 2,4,6-trimethyl group, a 4-phenyl group, a 4-phenoxy group, a 4-acetamido group, etc., and benzenediazo sulfonates having a substituent such as a 4-(N-ethyl-N-benzylamino) group, a 4-(N,N-dimethylamino) group, a 4-(N,N-diethylamino) group, a 4-(N,N-diethylamino)-3-chloro group, a 4-pyrrolidino-3-chloro group, a 4-morpholino-2-methoxy group, a 4-(4'-methoxybenzoylamino)-2,5-dibutoxy group, a 4-(4'-trimercapto)-2,5-dimethoxy group, etc.

In the case of using these diazo sulfonate compounds, it is preferred to irradiate the recording material with light for activating the diazo sulfonate before performing heat printing.

The diazoamino compound which can be used as the diazo compound in this invention is a diazo compound the diazo group of which is coupled with dicyandiamide, sarcosine, methyltaurine, N-ethylanthranic acid, 5-sulfonic acid, monoethanolamine, diethanolamine, guanidine, etc.

The coupling component to be used in the present invention is a compound which couples with the diazo compound (diazonium salt) to form a dye. Such coupling component includes a compound of the type that the coloration is accelerated depending upon the presence of a basic substance, and a compound of the type that the high coloration density is obtained regardless of the presence of a basic substance. The typical examples of the former type coupling components depending upon the basic substance include resorcin, phloroglucin, sodium 2,3-dihydroxynaphthalene-6-sulfonate, 1-hydroxy-2-naphthoic acid-morpholinopropylamide, 1,5-dihydroxynaphthalene, 2,3-dihydroxynaphthalene, 2,3-dihydroxy-6-sulfanylnaphthalene, 2-hydroxy-3-naphthoic acid-anilide, 2-hydroxy-3-naphthoic acid-2'-methylanilide, 2-hydroxy-3-naphthoic acid-ethanolamide, 2-hydroxy-3-naphthoic acid-octylamide, 2-hydroxy-3-naphthoic acid-N-dodecyloxypropylamide, 2-hydroxy-3-naphthoic acid-tetradecylamide, acetanilide, acetoacetanilide, benzoylacetanilide, 1-phenyl-3-methyl-5-pyrazolone, 1-(2',4',6'-trichlorophenyl)-3-benzamido-5-pyrazolone, 1-(2',4',6'-trichlorophenyl)-3-anilino-5-pyrazolone, 1-phenyl-3-phenylacetamido-5-pyrazolone, etc. Typical examples of the latter type coupling components regardless of the presence of a basic substance include active methylene compounds, for example, β-keto-carboxylic acid amides such as benzoylacetanilide, pivaloylacetanilide, 1,3-bis(benzoylacetamino)toluene, 1,3-bis(pivaloylacetaminomethyl)benzene, etc., pyrazolones such as 3-methyl-1-phenylpyrazolone, 3-hexylcarbamoyl-1-phenylpyrazolone, 3-myristoylamino-1-(2,4,6-trichlorophenyl)-pyrazolone, etc., barbituric acids such as 1,3-didodecylbarbituric acid, 1,3-dicyclohexylbarbituric acid, 1-octyl-3-stearylbarbituric acid, etc., 1,3-cyclohexanediones such as 5,5-dimethyl-1,3-cyclohexanedione, 5,5-dimethyl-4-phenyl-1,3-cyclohexanedione, etc.; aromatic amine type compounds, for example, α-naphthylamine, β-naphthylamine, 1-anilinonaphthalene, 2-anilinonaphthalene, 3-aminodiphenylamine, 4,4'-diaminodiphenylmethane, N,N-dicyclohexylaniline, 2-aminocarbazole, 2-phenylindole, 1-phenyl-2-methylindole, and organic or inorganic acid salts of an aromatic amine such as a p-toluenesulfonic acid salt of N,N-dimethylaniline and α-naphthylamine hydrochloride, etc.; and aromatic hydroxy compounds having a basic group in the molecular structure thereof, for example, 2-hydroxy-3-naphthoic acid-3'-morpholinopropylamide, 2-hydroxy-3-naphthoic acid-2'-diethylaminoethylamide, 2-hydroxy-3-naphthoic acid-3-piperidinopropylamide, 2-hydroxy-3-naphthoic acid-3'-piperidinopropylamide, 2-hydroxy-3-naphthoic acid-p-(3'-N'-cyanoguanidinopropyl)oxyanilide, salicylic acid-p-(3'-morpholinopropyl)oxyanilide, 1-naphthol-4-sulfonic acid-3'-diethylaminopropylamide, 8-hydroxyquinoline-4-sulfonic acid-2'-diethylaminoethylamide, and an aromatic hydroxy compound having a residue such as an organic carboxylic acid salt of amines capable of providing basic when heated, e.g., a trichloroacetic acid salt of 2-hydroxy-3-naphthoic acid-3'-morpholinopropylamide, a phenylthioacetic acid salt of 1-naphthol-4-sulfonic acid-3'-diethylaminopropylamide, etc. An image of an optional color may be obtained by using two or more of these coupling components in combination.

As the basic material for use in this invention, there are water-sparingly-soluble or water-insoluble basic materials, and materials capable of forming alkali by heating. Examples of these basic materials are inorganic and organic ammonium salts, organic amines, amides, urea or thiourea and the derivatives thereof, thiazoles, pyrroles, pyrimidines, piperazines, guanidines, indoles, imidazoles, imidazolines, triazoles, morpholines, piperidines, amidines, formamidines, pyridines, etc. Specific examples of these nitrogen-containing basic compounds are ammonium acetate, tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-ditolylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzothiazole, 2-benzoylhydrazino-benzothiazole, etc.

These basic materials may be used individually or as a mixture thereof.

Also, the auxiliary coloring agent or coloring aid which can be used in this invention is a material capable of increasing the coloring density or reducing the minimum coloring temperature at heat printing and it is considered that the auxiliary coloring agent functions to reduce the melting point of the coupler, alkali or the diazo compound, or to reduce the softening point of the microcapsule wall to form a state of easily causing the reaction of the diazo compound, alkali, and coupler.

The auxiliary coloring agent or coloring aid includes phenol compounds, alcoholic compounds, amido compounds, sulfonamido compounds, etc. Specific examples of them are p-t-octylphenol, p-benzyloxyphenol, phenyl p-oxybenzoate, benzylcarbanilate, phenethyl carbanilate, hydroquinone, dihydroxyethyl ether, xylylenediol, N-hydroxyethyl-methanesulfonic acid amide, N-phenylmethanesulfonic acid amide, etc.

The microcapsules for use in this invention can be prepared by emulsifying the core materials and forming a wall of polymer surrounding the oil droplets by a polymerization reaction. The reactant(s) for forming the polymer are added to the inside and/or the outside of the oil droplets. Specific examples of the polymers are polyurethane, polyurea, polyamide, polyester, polycarbonate, a urea-formaldehyde resin, a melamine resin, polyvinyl acetal, and a polymer of gelatin and aldehyde.

The polymers may be used singly or as a mixture of two or more polymers. Specific examples of preferred polymers are polyurethane, polyurea, polyamide, polyester, and polycarbonate, and are more preferably polyurethane and polyurea.

It is preferred that the polymer has a melting point of higher than 50° C., and is not melted at the temperature for heat recording.

Any components among the diazo compound, coupler, and basic material constituting the unit coloring group for use in this invention may be incorporated in the microcapsules individually or as a combination thereof. Also, in the case of two or more kinds of diazo compounds, couplers, or basic materials are employed, such may be incorporated in the same microcapsule or in different microcapsules.

For forming microcapsule walls, it is effective to use a microencapsulation method by the polymerization of reactants from the inside of the oil droplets. That is, in this case, microcapsules having uniform particle size and preferred for the recording materials having excellent shelf life can be obtained in a short period of time.

Practical examples of the microencapsulation method and the compounds for use in these methods are described in U.S. Pat. Nos. 3,726,804 and 3,796,669.

For example, in the case of using polyurethane as the microcapsule walls, a polyvalent isocyanate and a second material (e.g., polyol) for forming capsule walls by causing the reaction with the isocyanate are mixed in an oily liquid to be capsulated, the mixture is dispersed by emulsification in water, and the temperature is increased, whereby the polymer forming reaction occurs at the interfaces of the oil droplets to form microcapsule walls. In this case, an auxiliary solvent having low boiling point and a strong dissolving power can be used in the oily liquid.

The polyisocyanates and polyols or polyamines to be reacted with the polyisocyanates in this case are disclosed in U.S. Pat. Nos. 3,135,716, 3,281,383, 3,468,922, 3,773,695 and 3,793,268, Japanese Patent Publication Nos. 40347/73, 24159/74, Japanese Patent Application (OPI) Nos. 80191/73 and 84086/73.

Also, for accelerating the urethane reaction, a tin salt, etc., can be used together.

For forming microcapsules, a water-soluble polymer can be used for emulsification or preventing the occurrence of aggregation of emulsions. The water-soluble polymer includes a water-soluble anionic polymer, a water-soluble nonionic polymer and a water-soluble amphoteric polymer. As the anionic polymer, natural polymers or synthetic polymers may be used, including, for example, anionic polymers having $—COO^{\ominus}$ or $—SO_3^{\ominus}$. Specific examples are natural anionic polymers such as gum arabic, alginic acid, etc., and semisynthetic polymers such as carboxymethyl cellulose, phthalated gelatin, sulfated starch, sulfated cellulose, ligninsulfonic acid, etc.

Examples of synthetic anionic polymers include maleic anhydride series (including hydrolyzed ones) copolymers, acrylic acid and methacrylic acid series polymers and copolymers, vinylbenzenesulfonic acid series polymers and copolymers, carboxy-modified polyvinyl alcohol.

Examples of nonionic polymers include polyvinyl alcohol, hydroxyethyl cellulose, methyl cellulose, etc.

Examples of amphoteric polymers include gelatin, etc.

The above described water-soluble polymer is used as an aqueous solution of 0.01 to 10 wt % polymer.

The particle sizes of the microcapsules are adjusted to less than 20 microns. When the particle sizes of the microcapsules are over 20 microns, the printed image quality is liable to be deteriorated.

When heating by a thermal head is performed from the coated layer side, it is preferred that the particle size of the microcapsules is less than 8 microns in order to prevent the occurrence of pressure fog.

The microcapsules can be formed from an emulsion containing at least 0.2 wt % components to be microencapsulated.

It is preferred to use 0.1 to 10 parts by weight of the coupling component and 0.1 to 20 parts by weight of the basic material per 1 part by weight of the diazo compound. The amount of the organic solvent is 2 to 50 parts by weight, preferably 5 to 25 parts by weight. Also, it is preferred to coat the diazo compound at a coverage of 0.05 to 20 g/m$^2$.

The diazo compound, coupling component and the basic material for use in this invention need not be microencapsulated in this invention, and, in such a case, they are preferably used as solid dispersion prepared by a sand mill, etc. In this case, each component is dispersed in an aqueous solution of a water-soluble polymer. Examples of preferred water-soluble polymers include water-soluble polymers as described in the case of forming microcapsules. In this case, the concentration of the water-soluble polymer is from 2 to 30% by weight, and the diazo compound, the coupling component, and the basic material are added to the aqueous solution of the water-soluble polymer so that the concentration of each component becomes 5 to 40% by weight. It is preferred that the sizes of the particles of these components thus dispersed are less than 10 microns.

For the light filter layer which is used in this invention, various compounds having a spectral absorption at a desired wavelength region can be used. Also, when these compounds are used for the light filter layer, it is preferred that the compound exists in the layer as uniform as possible. The above described compound may exist in the form of being mechanically kneaded into a polymer such as polyvinyl alcohol, polyvinylpyrrolidone, etc., or a light absorptive compound having an anionic group may be fixed in a polymer having a cationic group by the interaction of the ions, or a light absorptive compound having a cationic group may be fixed in a polymer having an anionic group. Furthermore, a polymer having a light absorptive site as the main chain or a pendant group in the molecule may be used in this invention. Also, a light absorptive compound may be used as the form of an emulsified dispersion in a water-insoluble oil or the emulsified dispersion may be finely absorbed in a polymer latex. Furthermore, a light absorptive compound may be dissolved in a water-miscible organic solvent, the solution is mixed with a polymer latex liquid to be impregnated into the polymer particles, and thereafter, the organic solvent is removed to provide a dispersion, which is used for the light filter layer. Also, the light absorptive compound may be added to the organic solvent in the above described microcapsules.

As the light absorptive compounds which can be used in this invention, there are salicylic acid series compounds such as phenyl salicylate, p-octyl salicylate, etc.; aqueous polyester; benzophenone series compounds such as 2,4-dihydroxybenzophenone, 2-hydroxy-4-methoxybenzophenone, 2,2'-dihydroxy-4-methoxybenzophenone, etc.; benzotriazole series compounds such as 2-(2'-hydroxy-5'-methylphenyl)benzotriazole, 2-(2'-hydroxy-3'-tert-butyl-5'-methylphenyl)-5-chlorobenzotriazole, etc.; tinuvin series compounds; dicyanobutadiene series compounds; acridine compounds such as 9-aminoacridine, etc. Also, in the case of a multilayer structure, the upper layer may be used as a filter layer by utilizing the light absorptive character of the upper layer.

For the heat-sensitive recording materials of this invention, a pigment such as silica, barium sulfate, titanium oxide, aluminum hydroxide, zinc oxide, calcium carbonate, etc.; styrene beads; or a fine powder of a urea-melamine resin, etc., can be used for preventing sticking to a thermal head or improving writability of the recording material.

Also, similarly, a metal soap, etc., may be used for preventing sticking of the recording material. The amount of the aforesaid material is generally from 0.2 to 7 g/m$^2$.

Furthermore, for the heat-sensitive recording materials of this invention, a heat melting material may be used for increasing the thermal recording density. Such a heat melting material is a material having a melting point of 50° to 150° C., which is solid at normal (room) temperature but is melted by heating with a thermal head, and also is a material capable of dissolving the diazo compound, the coupling component or the auxiliary coloring agent or a coloring aid. The heat melting material is used as a dispersion of the particles thereof of 0.1 to 10 microns in size, and as a solid content amount of, generally, from 0.2 to 7 g/m$^2$. Specific examples of the heat melting material are fatty acid amides, N-substituted fatty acid amides, ketone compounds, N-substituted carbamate compounds, urea compounds, esters, etc.

The heat-sensitive recording material of this invention can be prepared using a proper binder.

Examples of the binder for use in this invention include various kinds of emulsions of polyvinyl alcohol, methyl cellulose, carboxymethyl cellulose, hydroxypropyl cellulose, gum arabic, gelatin, polyvinylpyrrolidone, casein, a styrene-butadiene latex, an acrylonitrile-butadiene latex, polyvinyl acetate, polyacrylic acid ester, an ethylene-vinyl acetate copolymer, etc. The amount of the binder is generally from 0.5 to 5 g/m$^2$ (solids content).

The heat-sensitive recording material of this invention may further contain citric acid, tartaric acid, oxalic acid, boric acid, phosphoric acid, pyrophosphoric acid, etc., as an acid stabilizer.

In one embodiment of this invention, at least one of the diazo compound, the coupling component, the basic material, and the auxiliary coloring agent or coloring aid is dissolved or dispersed in an organic solvent and then microencapsulated as described above. Remaining reactive material(s) are solid-dispersed or dissolved in water and, then, the resulting dispersion or aqueous solution is dispersed in the above described dispersion of the microcapsules to form a coating liquid. The coating liquid is coated on a support such as a paper or a synthetic resin film by a coating method such as bar coating, blade coating, air knife coating, gravure coating, roll coating, spray coating, dip coating, etc., and dried to form a heat-sensitive layer of, generally, from 2.5 to 15 g/m$^2$ as solids content. Also, in other embodiment of this invention, a layer of the microcapsules containing a reactive material and an organic solvent and a layer containing remaining reactive material(s) are formed on a support as a double layer structure.

Further, the plural heat-coloring elements used herein may be present in the same one layer, or each heat-coloring elements may be present in individual layers.

Also, as the support in this invention, a paper is advantageously used but a paper coated with a liquid prepared by dispersing a pigment such as calcium carbonate, kaolin, talc, alumina, etc., in a latex of polyvinyl alcohol, gelatin, carboxymethyl cellulose, hydroxyethyl cellulose, hydroxypropyl cellulose, etc., may also be used.

The heat-sensitive recording material of this invention can be used as a printer paper for facsimile or a computer requiring quick recording. In this case, the heat-sensitive recording material is required to have a specific light exposure zone for photodecomposition different from ordinary facsimile or printer.

The array of the printing heads and the exposure zones is generally classified into two manners. One is a so-called one head multi scanning system of repeating the step that after one performing heat printing, light irradiation for photodecomposition is applied to the heat-sensitive recording material, at about the same time as the light irradiation, the recording material returns to the once heat-printed place for another heat printing by means of a mechanism for delivering the recording material, then heat printing and light irradiation are applied to the recording material, and the recording material is returned. Another one is a so-called multi-head scanning system having recording heads of the number the same as the number of colors to be recorded and also light irradiating zones between the recording heads. If desired, both systems may be employed as a combination thereof.

As the light source for photodecomposition, various light sources each emitting light of the desired wavelengths can be used. For example, there are a fluorescent lamp for a wet diazo copying machine, a fluorescent lamp for an electrostatic photographic machine, a xenon lamp, a xenon flash lamp, a low pressure, intermediate pressure, high pressure or a superhigh pressure mercury lamp, a photographic flash lamp, an electric flash lamp, etc. Also, for making the light fixing zone compact, the light source and the light exposure portion may be separated using optical fibers.

Also, if desired, the once heat printed recording material can be placed under sunlight or a fluorescent lamp to fix by light of the visible wavelength region, and thereafter be subjected to heat printing again to provide a multicolor sample.

The following examples are intended to illustrate this invention but not to limit it in any way. All parts in the examples, unless otherwise indicated, are by weight.

EXAMPLE 1

(1) Preparation of Capsule Liquid A:

| | parts |
|---|---|
| Diazo Compound (having the structure shown below) | 3.4 |
| Tricresyl Phosphate | 6 |
| Methylene Chloride | 12 |
| Trimethylolpropane Trimethacrylate | 18 |
| Takenate D-110 N (75% by weight ethyl acetate solution, made by Takeda Chemical Industries, Ltd.) | 24 |

The above components were mixed and dispersed by emulsification in a mixture of 63 parts of an aqueous solution of 8% by weight of polyvinyl alcohol and 100 parts of distilled water at 20° C. to provide an emulsion containing particles having a mean particle size of 2 μm. The emulsion thus obtained was stirred for 3 hours at 40° C.

After cooling the emulsion to 20° C., 100 ml of an ion exchange resin, Amberlite IR-120B (trade name, made by Rhom and Haas Co.) was added to the emulsion followed by stirring for 1 hour and then the mixture was filtered to provide Capsule Liquid A.

Diazo Compound:

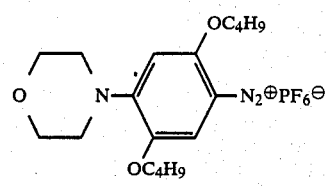

(2) Preparation of CApsule Liquid B:

| | parts |
|---|---|
| Diazo Compound (having the structure shown below) | 3.2 |
| Tricresyl Phosphate | 24 |
| Methylene Chloride | 24 |
| Takenate D-110 N (75% by weight ethyl acetate solution) | 24 |

The above components were mixed and dispersed by emulsification in a mixture of 63 parts of an aqueous solution of 8% by weight of polyvinyl alcohol and 100 parts of distilled water. By following the same procedure as the case of preparing Capsule Liquid A, Capsule Liquid B was obtained.

Diazo Compound:

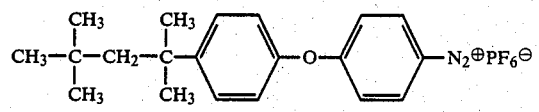

(3) Preparation of Coupler/Base Dispersion A:

| | parts |
|---|---|
| Coupler (having the structure shown below) | 14 |
| Base, Triphenyl Guanidine | 14 |
| Aqueous Solution of Polyvinyl Alcohol (4% by weight solution) | 138 |

The above components were dispersed by means of Dyno Mill (trademark for product of Willy A. Bachofen, A.G.) to provide Coupler/Base Dispersion A having a mean particle size of 3 μm.

Coupler:

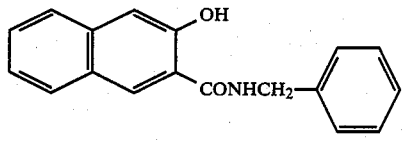

(4) Preparation of Auxiliary Coloring Agent Dispersion A:

| | parts |
|---|---|
| Auxiliary Coloring Agent (having the structure shown below) | 28 |
| Aqueous Solution of Polyvinyl Alcohol (4% by weight solution) | 138 |

The above components were dispersed by means of Dyno Mill (trademark for product of Willy A. Bachofen, A.G.) to provide Auxiliary Coloring Agent Dispersion A having a mean particle size of 3 μm.

Auxiliary Coloring Agent:

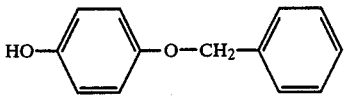

(5) Preparation of Recording Paper A:

| | parts |
|---|---|
| Capsule Liquid B | 4.9 |
| Aqueous Hydroquinone Solution (5% by weight solution) | 0.2 |
| Coupler/Base Dispersion A | 3.7 |

A mixture of the above components was coated on a smooth wood free paper (50 g/m$^2$) at a coverage of 25 ml/m$^2$, followed by air-drying.

| | parts |
|---|---|
| Capsule Liquid A | 4.9 |
| Aqueous Hydroquinone Solution (5% by weight solution) | 0.2 |
| Coupler/Base Dispersion A) | 3.7 |
| Auxiliary Coloring Agent Dispersion A | 7.4 |

A mixture of the above components was coated on the above prepared layer at a coverage of 25 ml/m$^2$, followed by drying.

Recording Paper A thus prepared was subjected to the following printout coloring test to determine the coloring property.

(6) Printout Coloring Test (hot plate heating method):

When a hot plate heated to 70° C., 80° C., 90° C., 100° C., 110° C., 120° C., or 130° C., was applied under pressure onto Recording Paper A for 1 second, the recording paper pressed by the hot plate of 90° C. showed clear blue colored images and the recording paper pressed by the hot plate of 120° C. showed blue-purple images. In this case, however, the blue-purple images are a comparison example and showed blue ooze.

Then, after irradiation the printed recording papers using Ricopy Super Dry 100 Type (trademark for product of Ricoh Company, Ltd.) (400 to 430 nm) for 10 seconds, each recording paper was pressed by a hot plate heated to 70° C., 80° C., 90° C., 100° C., 110° C., 120° C. or 130° C. for 1 second. In this case, the recording paper pressed by the hot plate of above 110° C. showed clear red colored images.

As described above, the recording paper of this invention printed at 90° C. before light irradiation showed clear blue colored images having no color mixing and color ooze and the recording paper printed at 120° C. after light irradiation showed clear red colored images having no color mixing or color ooze.

The red colored images were clear images showing neither color mixing nor color ooze.

In addition, when the recording paper of this invention was exposed to sunlight for 5 hours and then printed, different red colored images were not obtained.

EXAMPLE 2

(1) Preparation of Capsule Liquid A':

| | parts |
|---|---|
| Diazo Compound (having the following structure) | 3.4 |
| Tricresyl Phosphate | 6 |
| Methylene Chloride | 12 |
| Trimethylolpropane Trimethacrylate | 18 |
| Takenate D-110N (75% by weight ethyl acetate solution, made by Takeda Chemical Industries, Ltd.) | 24 |

The above components were mixed and dispersed by emulsification in a mixture of 63 parts of an aqueous solution of 8% by weight polyvinyl alcohol and 100 parts of distilled water at 20° C. to provide an emulsion containing particles having a mean particle size of 2 μm. The emulsion thus obtained was stirred for 3 hours at 40° C.

After cooling the emulsion to 20° C., 100 ml of an ion exhcange resin, Amberlite IR-120B (trade name, made by Rhom and Haas Co.) was added to the emulsion, followed by stirring for 1 hour and then the mixture was filtered to provide Capsule Liquid A'.

Diazo Compound:

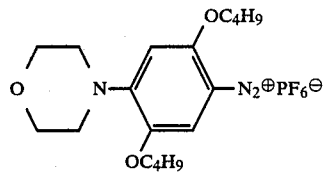

(2) Preparation of Capsule Liquid B':

| | parts |
|---|---|
| Diazo Compound (having the following structure) | 3.2 |
| Tricresyl Phosphate | 24 |
| Methylene Chloride | 24 |
| Takenate D-110N (75% by weight ethyl acetate solution) | 24 |

The above components were mixed and dispersed by emulsification in a mixture of 63 parts of an aqueous solution of 8% by weight polyvinyl alcohol and 100 parts of distilled water. By following the same procedure as the case of preapring Capsule Liquid A', Capsule Liquid B' was obtained.

Diazo Compound:

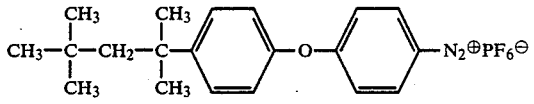

(4) Preparation of Coupler/Base Dispersion A':

| | parts |
|---|---|
| Coupler (having the following structure) | 14 |
| Base, Triphenyl Guanidine | 14 |
| Aqueous Solution of Polyvinyl Alcohol (4% by weight solution) | 138 |

The above components were dispersed by means of Dyno Mill (trademark for product of Willy A. Bachofen, A.G.) to provide Coupler/Base Dispersion A' having a mean particle size of 3 μm.

Coupler:

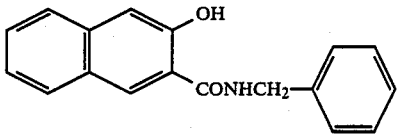

(4) Preparation of Auxiliary Coloring Agent Dispersion A':

| | parts |
|---|---|
| Auxiliary Coloring Agent (having the following structure) | 28 |
| Aqueous Solution of Polyvinyl Alcohol (4% by weight solution) | 138 |

The above components were dispersed by means of Dyno Mill (trademark for product of Willy A. Bachofen, A.G.) to provided Auxiliary Coloring Agent Dispersion A' having a mean particle size of 3 μm.

Auxiliary Coloring Agent:

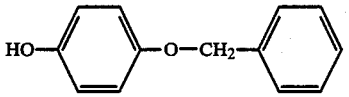

(5) Preparation of Recording Paper A':

| | parts |
|---|---|
| Capsule Liquid A' | 1.2 |
| Capsule Liquid B' | 1.6 |
| Aqueous Hydroquinone Solution (5% by weight solution) | 0.2 |
| Coupler/Base Dispersion A' | 1.85 |
| Auxiliary Coloring Agent Dispersion A' | 3.7 |

A mixture of the above components was coated on a smooth wood free paper (50 g/m$^2$) at a coverage of 25 ml/m$^2$, followed by air-drying and then coated again at a coverage of 25 ml/m$^2$, followed by air-drying.

Recording Paper A' thus prepared was subjected to the following print coloring test to determine the coloring property.

(6) Print Coloring (hot plate heating method) Test:

When a hot plate heated to 70° C., 80° C., 90° C., 100° C., or 110° C. was applied under pressure onto Recording Paper A' for 1 second, the recording paper was colored blue-purple by the hot plate having temperature of higher than 90° C. (Reflection density (OD) 1.0.)

When after irradiating Recording Paper A' by light of 400 to 430 nm for 10 seconds using Ricopy Super Dry 100 Type (trademark for product of Ricoh Company, Ltd.), each hot plate was applied under pressure to the recording paper for 1 second as described above, the recording paper was colored in red by the hot plate having temperature of higher than 90° C. (Reflection density (OD) 0.8.)

As described above, when the recording paper was subjected to heat printing before light irradiation, the recording paper was colored in blue-purple, but when the same kind of recording paper was subjected to heat printing after photodecomposing the diazonium salt by the irradiation of light, the recording paper was colored in red. The red colored image showed no color bleeding and no mixing of blue component was observed in the red image.

In addition, when after exposing the printed recording paper to sunlight for 5 hours, heat printing was applied to the recording paper, different red colored image was not obtained.

(7) Print Coloring (facsimile) Test:

When heat printing was applied to Recording Paper A' using a facsimile, MELFAS 600 (trademark for product of Mitsubishi Denki Kabushiki Kaisha), clear blue colored images were obtained. Then, after irradiating the resulting recording paper for 10 seconds by light using Ricopy Super Dry 100 Type, heat printing was applied again to the recording paper, images added with clear red colored images were obtained.

While the invention has been described in detail and with reference to specific embodiments thereof, it will be apparent to one skilled in the art that various changes and modifications can be made therein without departing from the spirit and scope thereof.

What is claimed is:

1. A recording method comprising (1) heat-coloring a first heat-coloring element of a heat-sensitive recording material comprising a support having formed thereon plural heat-coloring elements coloring in two or more different hues, each element comprising a diazo compound and a coupling component causing heat coloring, and the coloring process of each heat-coloring element being able to be stopped by the action of different radiation, (2) stopping the heat-coloring property of the uncolored portions of the first heat-coloring element by radiation, and then (3) heat-coloring another of said heat-coloring elements,; whereby said heat-coloring procedure is conducted at least 2 times and said radiation is conducted at least 1 time to form recorded images composed of two or more colors on the same sheet.

2. A recording method as in claim 1, wherein said first heat-coloring element is colored at the lowest temperature and is heat-colored, and after stopping the heat-coloring property of the uncolored portions of said first heat-coloring element by radiation, another heat-coloring element which is colored at a higher temperature is heat-colored.

3. A recording method as in claim 1, wherein a heat-coloring element is first heat-colored, and after stopping the heat-coloring property of the uncolored portions of the heat-coloring element by radiation, another heat-coloring element is heat-colored at substantially the same temperature as the initial coloring temperature.

4. A recording method as in claim 1, wherein said diazo compound is incorporated in microscapsules.

5. A recording method as in claim 4, wherein said microcapsules further contain an auxiliary coloring agent.

6. A heat-sensitive recording material comprising a support having formed thereon plural heat-coloring elements, each comprising a diazo compound and a coupling component causing heat-coloring, each of said heat-coloring elements coloring at a different temperature and each of said diazo compounds in the heat-coloring elements being decomposed by radiation having a respectively different wavelength.

7. A heat-sensitive recording material as in claim 6, wherein the diazo compound is incorporated in microcapsules.

8. A heat-sensitive recording material as in claim 7, wherein said microcapsules further contain an auxillary coloring agent.

9. A heat-sensitive recording material comprising a support having formed thereon plural heat-coloring elements, each comprising a diazo compound and a coupling component causing heat-coloring, each of said heat-coloring elements being colored at substantially the same temperature but coloring in a different hue and the diazo compounds in said plural heat-coloring elements each being decomposed by radiation having different wavelengths.

10. A heat-sensitive recording material as in claim 9, wherein the diazo compound is incorporated in microcapsules.

11. A heat-sensitive recording material as in claim 10, wherein said microcapsules further contain an auxiliary coloring agent.

* * * * *